US009010964B2

(12) United States Patent
Wang

(10) Patent No.: US 9,010,964 B2
(45) Date of Patent: Apr. 21, 2015

(54) LED LIGHT BULB WITH INTERIOR FACING LEDS

(75) Inventor: Tien Yang Wang, Hsinchu (TW)

(73) Assignee: Epistar Corporation, Hsinchu (TW)

( * ) Notice: Subject to any disclaimer, the term of this patent is extended or adjusted under 35 U.S.C. 154(b) by 241 days.

(21) Appl. No.: 13/456,299

(22) Filed: Apr. 26, 2012

(65) Prior Publication Data

US 2013/0286664 A1 Oct. 31, 2013

(51) Int. Cl.

| | |
|---|---|
| ***F21V 7/05*** | (2006.01) |
| ***F21K 99/00*** | (2010.01) |
| ***F21V 3/04*** | (2006.01) |
| ***F21V 7/04*** | (2006.01) |
| *F21V 13/02* | (2006.01) |
| *F21V 29/00* | (2006.01) |
| *F21Y 101/02* | (2006.01) |
| *F21Y 111/00* | (2006.01) |

(52) U.S. Cl.

CPC . *F21K 9/135* (2013.01); *F21K 9/50* (2013.01); *F21V 3/0418* (2013.01); *F21V 3/0436* (2013.01); *F21V 7/04* (2013.01); *F21V 7/041* (2013.01); *F21V 13/02* (2013.01); *F21V 29/20* (2013.01); *F21Y 2101/02* (2013.01); *F21Y 2111/001* (2013.01)

(58) Field of Classification Search

CPC ..... F21S 4/003; F21S 4/008; F21V 7/0066; F21V 7/0083; F21V 7/041; F21V 15/011; F21V 19/0025; F21V 19/0075; H01L 33/58; H01L 33/60; H01L 33/64

USPC ..... 362/650, 240, 241, 249.02, 294

See application file for complete search history.

(56) References Cited

U.S. PATENT DOCUMENTS

| | | | | |
|---|---|---|---|---|
| 6,409,361 | B1 * | 6/2002 | Ikeda | 362/240 |
| 6,796,698 | B2 * | 9/2004 | Sommers et al. | 362/555 |
| 7,611,264 | B1 * | 11/2009 | Chang et al. | 362/249.02 |
| 7,905,626 | B2 | 3/2011 | Shantha et al. | |
| 7,926,975 | B2 * | 4/2011 | Siemiet et al. | 362/240 |
| 7,960,872 | B1 * | 6/2011 | Zhai et al. | 362/231 |
| 8,324,645 | B2 * | 12/2012 | Liu et al. | 257/98 |
| 8,371,722 | B2 * | 2/2013 | Carroll | 362/311.02 |
| 8,425,086 | B2 * | 4/2013 | Chen et al. | 362/294 |
| 8,573,806 | B1 * | 11/2013 | Moon | 362/249.02 |
| 8,602,577 | B2 * | 12/2013 | Luo et al. | 362/84 |
| 2006/0268555 | A1 * | 11/2006 | Kelly | 362/341 |
| 2007/0002572 | A1 * | 1/2007 | Ewig et al. | 362/470 |
| 2009/0302730 | A1 * | 12/2009 | Carroll et al. | 313/46 |
| 2013/0170221 | A1 * | 7/2013 | Isogai et al. | 362/300 |

* cited by examiner

*Primary Examiner* — Ismael Negron

(74) *Attorney, Agent, or Firm* — Ditthavong & Steiner, P.C.

(57) ABSTRACT

An LED light bulb includes a base, a light transmissive cover and upstanding light bars. The base is in electrical communication with a power source and has an axis and a periphery. The light transmissive cover is substantially mounted on the periphery. The upstanding light bars are mounted radially around the axis and located between the axis and the periphery. The upstanding light bars are arranged to substantially emit light inward to the axis.

20 Claims, 9 Drawing Sheets

| Embodiments | operation voltage | amount of white LED chips | number of white micro LEDs in each white chip | amount of red LED chips | number of red micro LEDs in each red chip |
|---|---|---|---|---|---|
| LED1 | 110ACV | 2 | 12 | 2 | 6 |
| LED2 | 110ACV | 3 | 8 | 1 | 12 |
| LED3 | 220ACV | 2 | 24 | 2 | 12 |
| LED4 | 220ACV | 3 | 16 | 1 | 24 |

LED LIGHT BULB WITH INTERIOR FACING LEDS

BACKGROUND

The present disclosure relates generally to LED light bulbs, and more specifically to LED light bulbs capable of replacing conventional light bulbs.

As well known in the art, there are different kinds of lighting fixtures developed in addition to the familiar incandescent light bulb, such as halogen lights, florescent lights and LED (light emitting diode) lights. LED light bulbs have several advantages. For example, LEDs have been developed to have lifespan up to 50,000 hours, about 50 times long as a 60-watt incandescent bulb. This long lifespan makes LED light bulbs suitable in places where changing bulbs is difficult or expensive (e.g., inaccessible places like the exterior of buildings). Furthermore, an LED requires minute amount of electricity to reach a luminous efficacy about 10 times higher than an incandescent bulb and 2 times higher than a florescent light. As power consumption and conversion efficiency are big concerns in the art, LED light bulbs are expected to replace several kinds of lighting fixtures in the long run.

Unlike incandescent light bulbs and florescent lights whose lights are omnidirectional, an LED transmits a focused beam of light. Defined by ENERGY STAR, a joint program of the U.S. Environmental Protection Agency and the U.S. Department of Energy, any lighting fixture proclaiming to replace an existing standard omnidirectional lamp or bulb is required to meet specific luminous intensity distribution. FIG. 1 demonstrates a lighting fixture intended to replace omnidirectional lamps or bulbs. There are some requirements for lighting fixtures intended to replace omnidirectional lamps or bulbs. As shown in FIG. 1, the distribution of luminous intensity shall be even within zone $Z_{front}$, the 0° to 135° zone, (vertically axially symmetrical) and the luminous intensity at any angle within zone $Z_{front}$ shall not differ from the mean luminous intensity for the entire zone $Z_{front}$ by more than 20%. Furthermore, at least 5% of total flux must be emitted in zone $Z_{rear}$, the 135° to 180° zone, in the proximity of the base contact. Light reflectors, diffusers, and lens have been employed in LED light bulbs, to spread out the focused light beam of an LED. Nevertheless, it is still a challenge for an LED light bulb to meet the intensity distribution requirements of ENERGY STAR.

SUMMARY

Embodiments of the present application disclose an LED light bulb including a base, a light transmissive cover and upstanding light bars. The base is capable of being in electrical communication with a power source and has a axis and a periphery. The light transmissive cover is substantially mounted on the periphery. The upstanding light bars are mounted radially around the axis and located between the axis and the periphery. The upstanding light bars are arranged to substantially shine inward to the axis.

BRIEF DESCRIPTION OF THE DRAWINGS

The present application can be more fully understood by the subsequent detailed description and examples with references made to the accompanying drawings, wherein:

FIG. 100 shows an LED light bulb with the reflector;

DETAILED DESCRIPTION

The following embodiments are described in sufficient detail to enable those skilled in the art to make and use the present application. It is to be understood that other embodiments would be evident based on the present disclosure, and that improves or mechanical changes may be made without departing from the scope of the present application.

In the following description, numerous specific details are given to provide a thorough understanding of the application. However, it will be apparent that the application may be practiced without these specific details. In order to avoid obscuring the present application, some well-known configurations and process steps are not disclosed in detail.

Figure 2A:
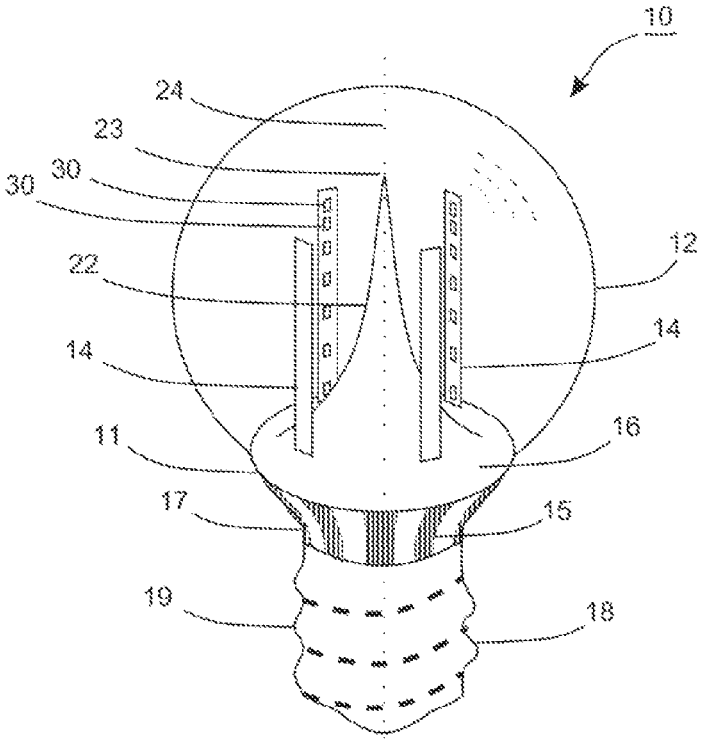
FIG. 2A shows a LED light bulb according to an embodiment of the present application.
Figure 2B:
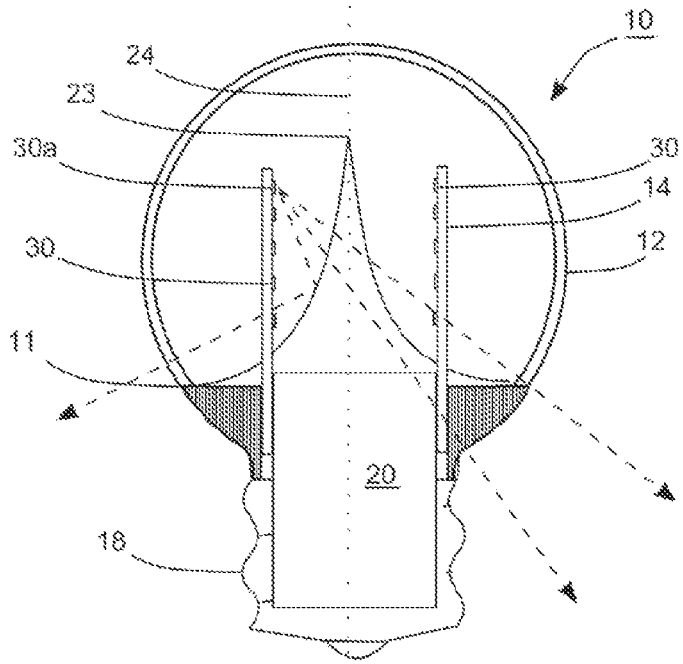
FIGS. 2B and 2C illustrate the cross section and top view of the LED light bulb in FIG. 2A, respectively.
Figure 2C:
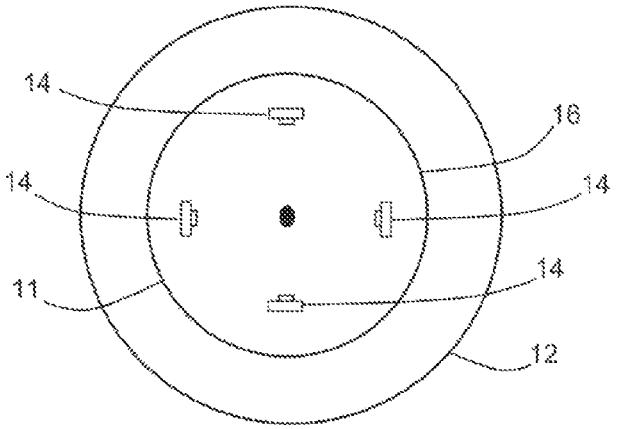

LED light bulb 10 according to an embodiment of the present application is shown in FIG. 2A. The cross section and top view of the LED light bulb 10 are shown in FIGS. 2B and 2C, respectively. LED light bulb 10 includes a bulb 12, light bars 14, a reflector 16, and a base 18. The LED light bulb 10 may be DC powered (e.g., from a battery, 6-12V) or AC powered (e.g., 110-120 or 220-240 VAC) or solar powered (e.g., connected to a solar cell). Each of the light bars 14 includes a plurality of light emitting diode (LED).

In the non-limiting embodiment of FIGS. 2A, 23, and 20, the base 18 has an Edison male base contact 19 that screws into a matching socket to electrically communicate with an electric power source (such as a branch circuit not shown). However, the application is not limited to this type of contact, and the LED light bulb 10 may have any other suitable contact, such as but not limited to, a single pin bayonet base, a double pin bayonet base (with one negative and one positive terminal in the base to match two contact points in a corresponding socket), a flange base, an MR16 socket base, or a wired connection. Positioned between the base contact 19 and the reflector 16 is a heat sink 17 with fins 15 to dissipate to the air the heat generated by light bars 14, which is electrically driven by an LED driving circuitry 20 encapsulated inside the base 18. The bulb 12 and the base 18 substantially define an internal space to seal the light bars 14 and the reflector 16. The place where the bulb 12 joins base 18 defines the periphery 11. In some embodiments, the bulb 12 is transparent or translucent glass. The bulb 12 is made by a polymer, such as polyurethane (PU), polycarbonate (PC), polymethylmethacrylate (PMMA), or polyethylene (PE), or a thermally conductive material, such as ZnO. The reflector 16 on the base 18 has a protruding portion 22 with an apex 23 substantially aligned to axis 24 of the LED light bulb 10. The curved surface of the reflector 16 reflects incoming light beams. The reflector 16 comprises Al, Ag or white paint, e.g., a $TiO_2$/resin mixture. The light bars 14, up standing inside bulb 12, are positioned on the reflector 16 that each having LEDs 30 longitudinally arranged or mounted thereon (e.g., in a pattern roughly in parallel with the length of the light bar 14). In another option, the positioning of the light bars 14 on the reflector 16 includes sticking. Accordingly, in a light bar 14, some LEDs 30 are close to the base 18, and some are upheld about in the middle of the internal space. The light bars 14 are also mounted radially around the protruding portion 22 in a circular pattern somewhere between the axis 24 and the periphery 11. Each light bar 14 has an emanating side arranged to basically face the axis 24 and shine inward to the axis 24 and the protruding portion 22. The emanating side has LEDs 30 mounted thereon. Shown in FIGS. 2A and 2B, each light bar 14 is a stick in shape with an upper portion of which has LEDs shining inside the internal space, and a lower portion of which is buried under the reflector 16 and mounted to the LED driving circuitry 20. In some embodiments, each light bar 14 has a back side (opposite the emanating side) with a reflective surface.

Figure 1:
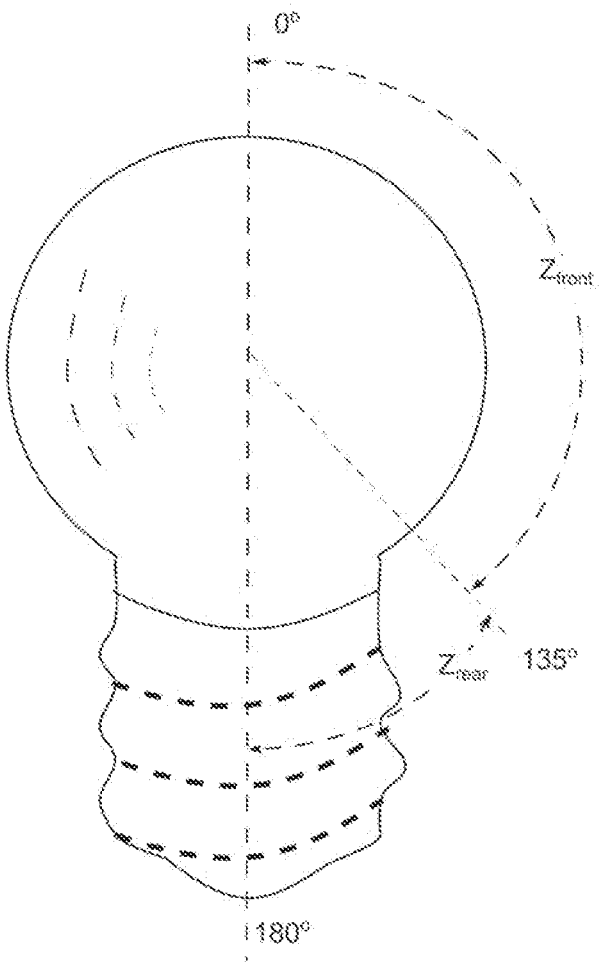
FIG. 1 demonstrates a lighting fixture intended to replace omnidirectional lamps or bulbs.

It is also obvious that some light beams from LEDs 30 can reach the direction opposite the base 18, that is, some light beams shine upward. Nevertheless, some light beams of the LED light bulb 10 can follow an angle nearby the base 18, that is, some light beams seemly shine downward. In FIG. 2B, there are several dash-lines with arrows to refer light beams from an LED 30*a*. The LED 30*a*, being on the far end of light bar 14, is in a top part of the LED light bulb 10, such that the light beams exemplified in FIG. 2B can reach, directly or reflectively, a surrounding area in proximity of the base 18. Accordingly, the LED 30*a* is capable of making the LED light bulb 10 emit light downward to an area adjacent to the base 18. Because the LED 30*a* is held up inside the LED light bulb 10 and emits light inward, it is much easier for the LED light bulb 10 to emit some light in the 135° to 180° zone of FIG. 1. The light bars 14, the LEDs 30, and the reflector 16 could be well designed or arranged to make the LED light bulb 10 a replacement of a standard omnidirectional light bulb having a luminous intensity distribution meeting the requirements of ENERGY STAR.

Figure 3:
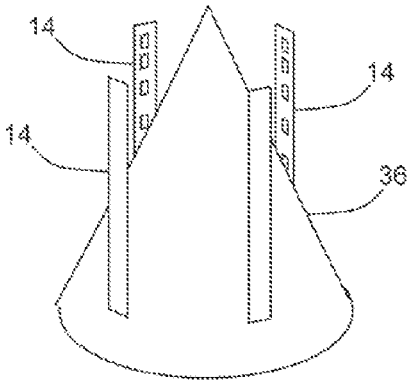
FIG. 3 demonstrates a reflector as a reflective cone with a tilted sidewall while light bars are on the sidewall of the reflector.
Figure 4A:
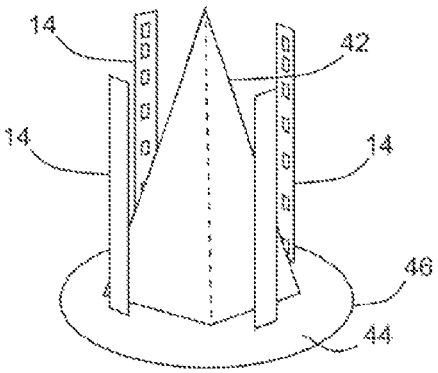
FIGS. 4A and 4B demonstrate a reflector including both a reflective flat portion and a square pyramid.
Figure 4B:
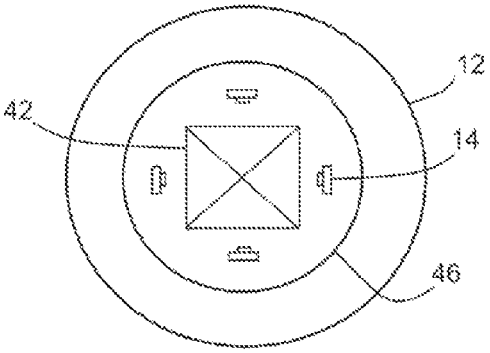
Figure 5:
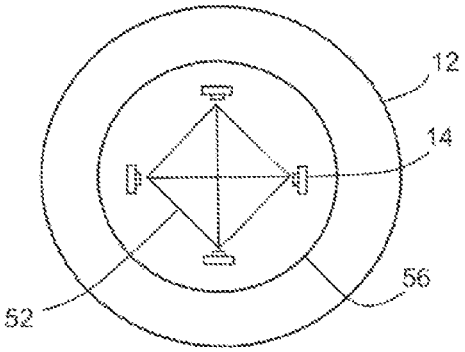
FIG. 5 shows a top view of an LED light bulb, in which each light bar 14 is positioned to substantially face a joining edge of a square pyramid.
Figure 6A:
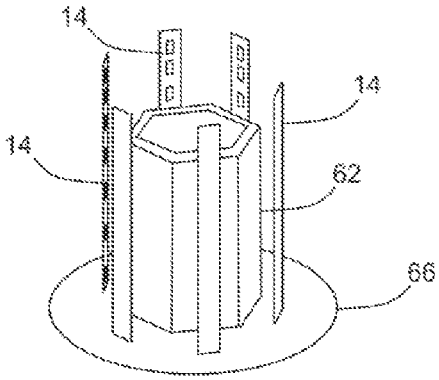
FIG. 6A demonstrates a reflector with a hollow hexagonal prism.
Figure 6B:
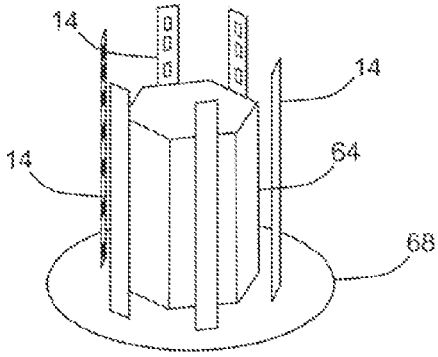
FIG. 6B demonstrates a reflector with a solid hexagonal prism.

In FIGS. 2A, 2B and 2C, the reflector 16 with the protruding portion 22 has a profile like a horn with a curved sidewall, and the light bars 14 are positioned on the curved sidewall. In another option, the positioning of the light bars 14 on the reflector 16 includes sticking. However the application is not limited to this type of profile, and the reflector 16 may have any other suitable profile, such as but not limited to, a cone, a pyramid, a cylinder, a uniform prism, or any polyhedron. A different profile of a reflector could yield a different luminous intensity distribution. FIG. 3 demonstrates the reflector 36 as a reflective cone with a tilted sidewall while the light bars 14 are positioned on the sidewall of the reflector 36. FIGS. 4A and 4B demonstrate the reflector 46 including both a reflective flat portion 44 facing upward opposite to a base and a square pyramid 42 as a protruding portion, while the light bars 14 up stand on the flat portion 44. Shown in FIGS. 4A and 4B, each light bar 14 is positioned to substantially face a joining triangle face of the square pyramid 42. Accordingly to another embodiment of the application, FIG. 5 shows a top view of a LED light bulb, in which the reflector 56 also has the square pyramid 52 as a protruding portion but each light bar 14 is positioned to substantially face a joining edge of the square pyramid 52. FIG. 6A demonstrates the reflector 66 with a hexagonal prism 62 as a protruding portion and the light bars 14 facing sidewalls of the hexagonal prism 62. Unlike the hexagonal prism 62 of FIG. 6A which has a hollow body, the hexagonal prism 64 on the reflector 68 of FIG. 6B has s solid body.

Figure 7A:
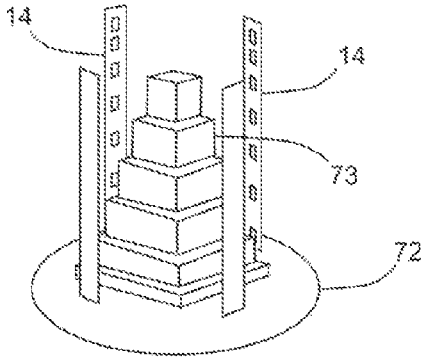
FIGS. 7A, 7B, 7C and 7D demonstrate four reflectors; each having a protruding portion with a multi-layer structure.
Figure 7B:
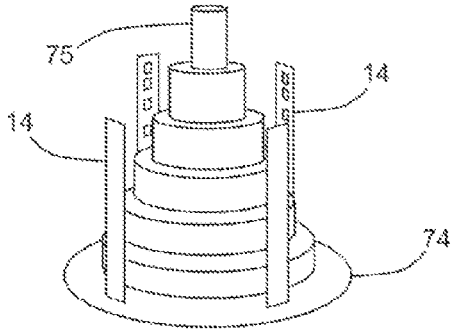
Figure 7C:
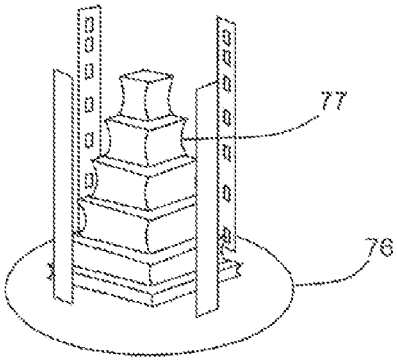
Figure 7D:
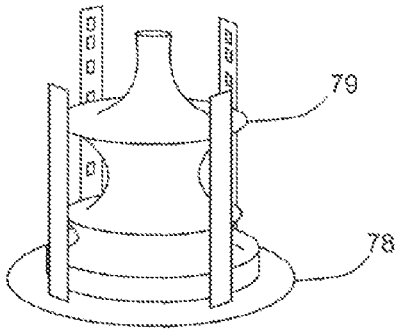

FIGS. 7A, 7B, 7C and 7D demonstrate four reflectors 72, 74, 76, and 78, each having a protruding portion with a multilayer structure. In FIG. 7A, each layer in protruding portion 73 is a cuboid, and the upper layer the smaller bottom face. In FIG. 7B, each layer of the protruding portion 75 is a cylinder. Each cuboid of the protruding portion 77 in FIG. 7C has curved sidewalls. So does each cylinder of the protruding portion 79 in FIG. 7D.

Figure 8A:
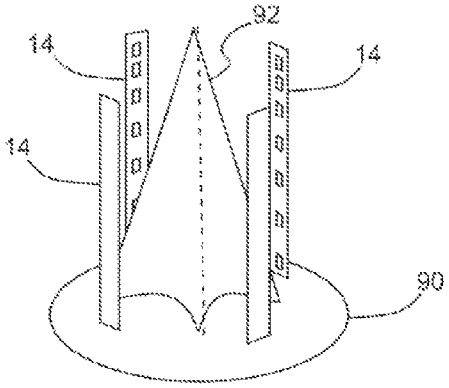
FIGS. 8A and 8B show perspective and top views of a reflector.
Figure 8B:
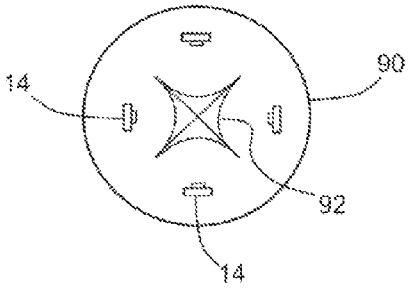
Figure 9A:
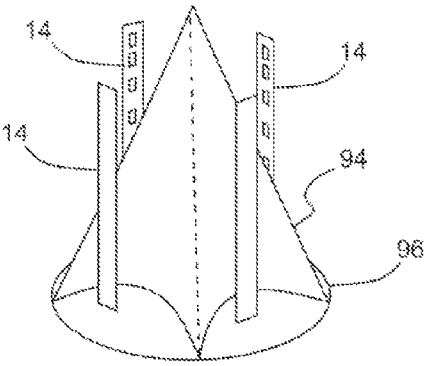
FIGS. 9A and 9B show those of another reflector, according to embodiments of the present application
Figure 9B:
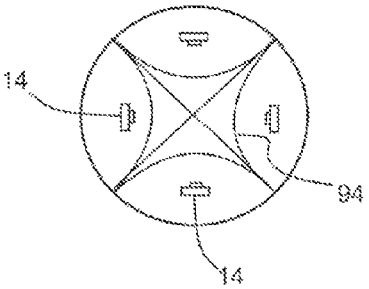

In some embodiments, the sidewalls of a protruding portion might be concave. FIGS. 8A and 83 show perspective and top views of the reflector 90, and FIGS. 9A and 9B show those of another reflector 96, according to embodiments of the application. As demonstrated in FIGS. 8A, 8B, 9A, and 93, each of the protruding portions 92 and 94 has curved sidewalls where the light bars 14 face. The bottom of the protruding portion 94 touches the boundary circle where the reflector 96 conjoins a bulb, but the bottom of the protruding portion 92 does not.

Figure 10A:
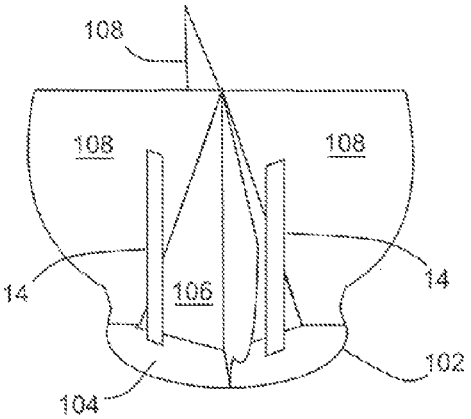
FIGS. 10A and 10B show perspective and top view of a reflector according to an embodiment of the application.
Figure 10B:
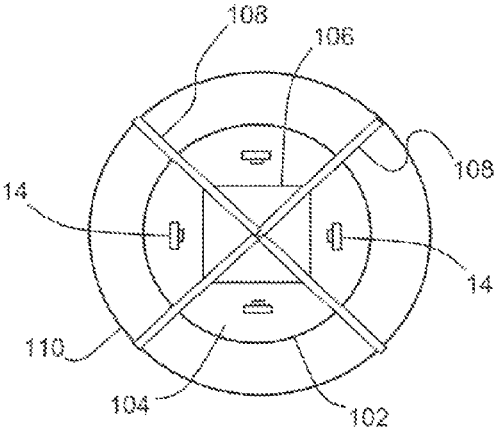
Figure 10C:
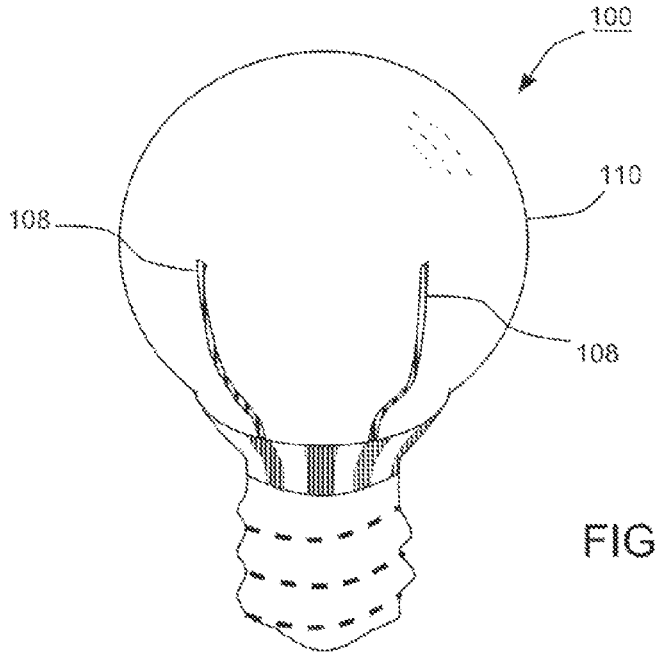
Figure 11A:
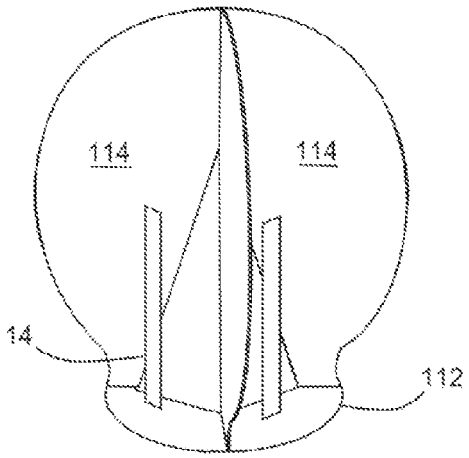
FIG. 11A shows another reflector according to an embodiment of the application.
Figure 11B:
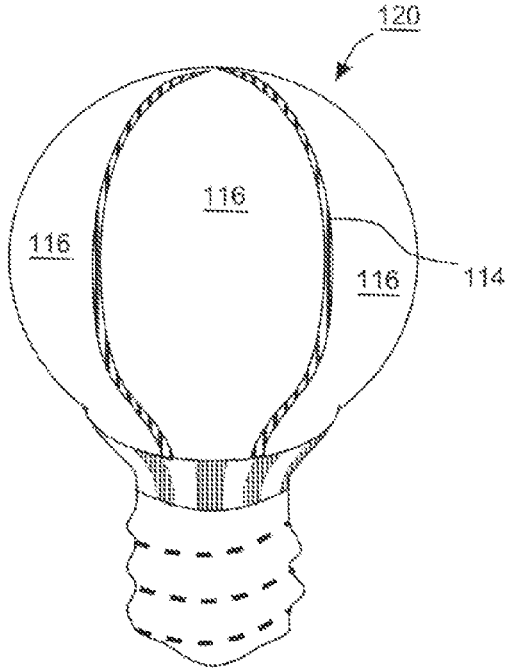
FIG. 11B shows a perspective view of an LED light bulb with the reflector in FIG. 11A.

FIGS. 10A and 103 show perspective and top views of a reflector 102 according to an embodiment of the application, and FIG. 10C shows the LED light bulb 100 with the reflector 102. The reflector 102 basically has a flat portion 104, a square pyramid 106 as a protruding portion, and four fins 108, all functioning to reflect light beams. Each fin 108 is connected to a joining edge of the square pyramid 106 and may extend outward to join the bulb 110. As shown in FIG. 100, the reflective fins 108 and the bulb 110 form an exterior of the LED light bulb 100. Shown in FIG. 11A is another reflector 112 according to an embodiment of the application. FIG. 11B shows a perspective view of the LED light bulb 120 with the reflector 112 in FIG. 11A. Unlike the reflector 102 of FIG. 10A whose reflective fins 108 have top edges at a distance away from the bulb 110, the reflective fins 114 of the reflector 112 divide the internal space of the bulb 116 into several isolated spaces. In another embodiment, the reflective fins 114 may track the envelope of the bulb 120 to the top and the apex of the protruding portion of the reflector 112 may also extend to the top of the bulb 120. The face of the reflector 112 between the reflective fins 114 may vary in shape, for example, a flat, curved, or angled side face. FIG. 11B also demonstrates the fins 114 and the bulb 116 form an exterior of the LED light bulb 120.

Figure 12A:
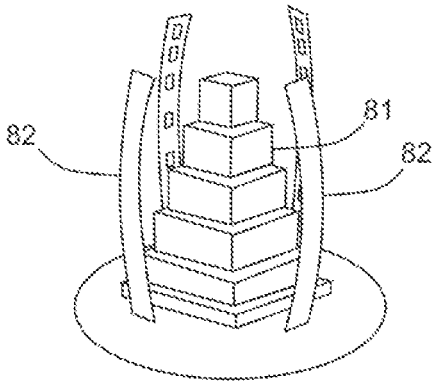
FIGS. 12A and 12B show that light bars are bent inward and outward, respectively.
Figure 12B:
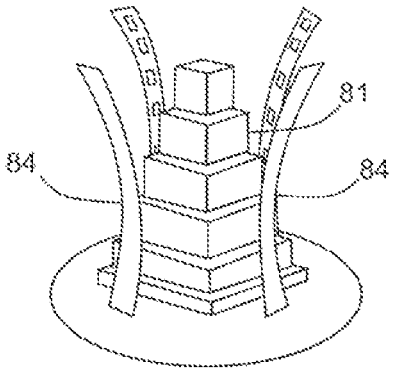

Previous embodiments demonstrate light bars each standing as a straight line, but the application is not limited to. FIG. 12A shows that the light bars 82 are all bent inward to the protruding portion 81, forming a shape like a flower bud. FIG. 12B shows, nevertheless, that light bars 84 are all bent outward (convex from the perspective on the protruding portion 81), forming a shape like a blossom.

Figure 13A:
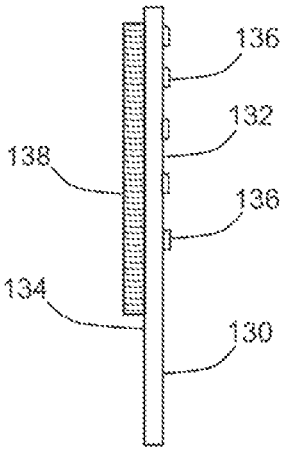
FIG. 13A shows a light bar with a heat sink.
Figure 13B:
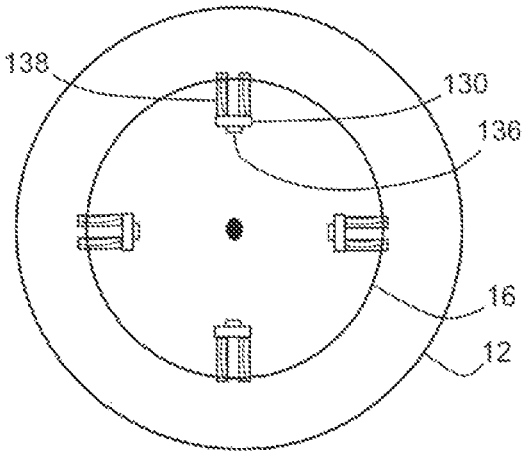
FIG. 13B shows a top view of a LED bulb with the light bar of FIG. 13A.
Figure 14A:
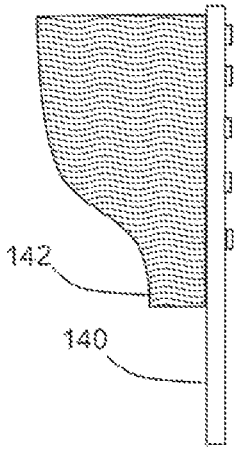
FIGS. 14A and 14B show a light bar, whose heat sink extends to join a bulb.
Figure 14B:
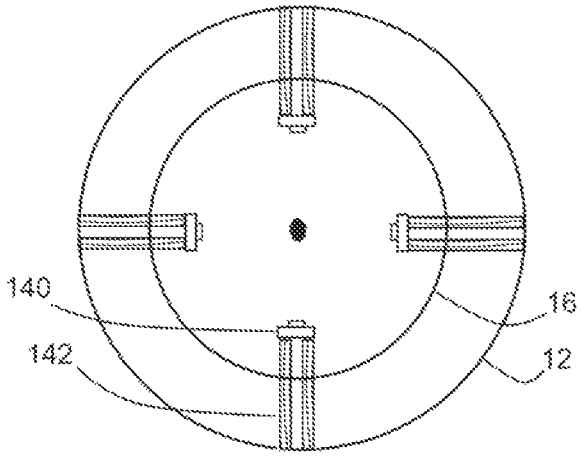
Figure 14C:
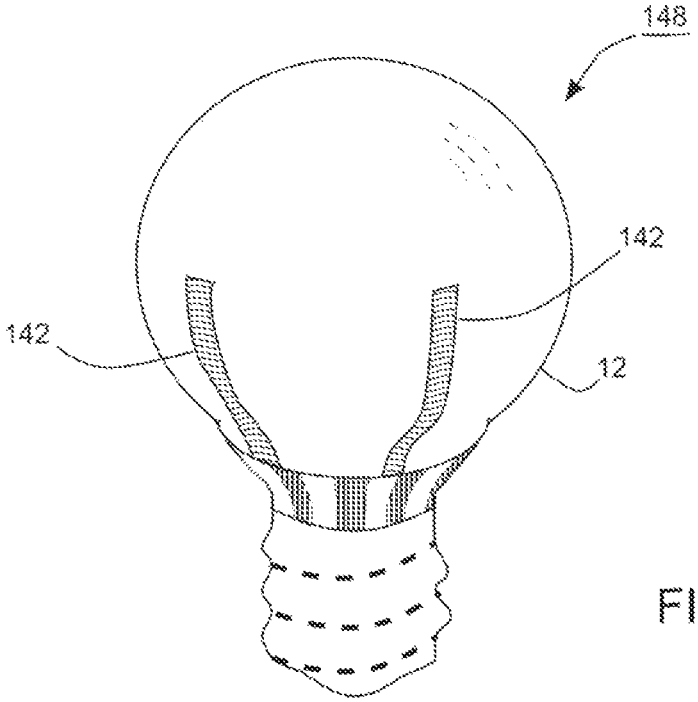
FIG. 14C shows that an exterior of a LED light bulb is formed by a bulb and heat sinks.

For high power LEDs, a light bar might be equipped with a heat sink of its own. FIG. 13A shows a light bar 130, including LEDs 136 mounted on its emanating side 132 and a heat sink 138 on its back side 134. FIG. 13B is the same with the top view of FIG. 2C, but the light bars therein are replaced by light bar 130 of FIG. 13A. Similarly, FIGS. 14A and 14B show a light bar 140, whose heat sink 142 extends to join bulb 12. FIG. 14C shows the bulb 12 and the heat sink 142 form an exterior of the LED light bulb 148. As the heat sink 142 is exposed, a very short thermal dissipation path is formed for effective heat dissipation from the LEDs, to the heat sink 142, and to the air.

In a non-limiting embodiment, a light bar includes ZnO, Al or a thermally conductive printed circuit board to conduct the heat generated from the LEDs thereon to a heat sink. In one embodiment, the light bar includes ZnO nanowire formed thereon for improving heat radiation. The light bar has a thermal conductivity of 10-16 W/m·K. In another embodiment, a light bar has a transparent or translucent printed circuit board allowing certain percent of light to pass through. As shown in the drawings of FIGS. 4A, 4B, 6A and 6B, the light bars 14 are mounted on a reflector in a circular pattern. The four light bars 14 in FIG. 4A or 4B form seemly a square, and the six light bars 14 in FIG. 6A or 6B form a hexagon. In other words, light bars in an embodiment of the application can be arranged in a polygon pattern surrounding an axis.

Figures 15A, 15B:
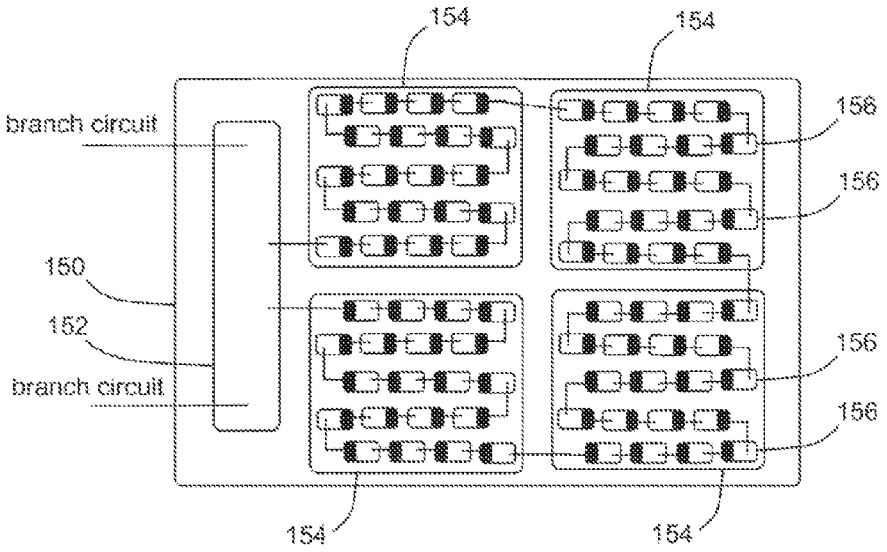
FIG. 15A shows an AC-powered LED according to an embodiment of the application.
FIG. 15B lists the configurations of four exemplified LEDs.

In one non-limiting embodiment, the LEDs in a LED light bulb all are of the same color. In another embodiment, the LEDs have different colors, which for example are green, red, blue, and white. For example, the LEDs on a light bar according to an embodiment of the application are white and red LEDs sequentially and alternatively arranged in a predetermined line pattern, and the ratio of the number of the white LEDs to the red ones is about 3 to create a warm white LED light bulb. FIG. 15A shows an AC-powered LED 150, which, for example, can be any one of the LEDs mounted on a light bar of an LED light bulb according to an embodiment of the application. The LED 150 has several LED chips 154 arranged in a 2×2 array and a rectifier 152. Each LED chip 154 has micro LEDs 156 connected in series, and all LED chips 154 are coupled to have all micro LEDs 156 connected in series. The rectifier 152 are coupled to a branch circuit, which is alternative-current 110V or 220V for example, and provides a rectified direction-current voltage source to drive micro LEDs 156. The LED chips 154 may be the same or different from each other. For example, one of LED chips 154 might be a blue LED chip, in which each blue micro LED thereof has a light-emitting layer made of indium gallium nitride (InGaN) to emit blue light with a peak wavelength between 440 to 480 nanometers. A white LED chip could be generated by coating a blue LED chip with a fluorescent material that converts some of the blue light into yellow light with a peak wavelength between 579 to 595 nanometers, and the micro LEDs in the white LED chip are referred to as white micro LEDs. The fluorescent material could be YAG or TAG as known in the art. One of LED chips 154 might be a red LED chip, in which each red micro LED thereof has a light-emitting layer made of aluminum gallium indium phosphide (AlGaInP) to emit a light with a peak wavelength between 600 to 650 nanometers. Optimizing the numbers of white, blue, and red LED chips or the numbers of white, blue, and red micro LEDs in the LED 150 can render it having not only a desired color temperature but also the capability of operating in a specific-voltage branch circuit. The table in FIG. 15B shows the chip numbers and the micro LED numbers in four exemplified LEDs for different branch circuits. Taking LED1 in the second row as an example, the LED1 is suitable to operate with a branch voltage of 110 ACV, and has 2 white LED chips and 2 red LED chips, each white LED chip having 12 white micro LEDs and each red LED chip having 6 red micro LEDs. LED2 to LED4 are not detailed because they are self-explanatory in view of the explanation of LED1. In one embodiment, the power ratio from that total consumed by all white micro LEDs to that total consumed by all red micro LEDs in a LED when driven is between 2 to 4, or about 3. The color temperature of an LED in an embodiment is between 2000K to 5000K, or preferably between 2000K to 3500K.

While the application has been described by way of example and in terms of preferred embodiment, it is to be understood that the application is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An LED light bulb, comprising:

a base;

a first upstanding light bar associated with the base and having an inner surface which an LED is arranged, and an outer surface opposite to the inner surface;

a light transmissive cover enclosing the inner surface and the outer surface, and having an inner sidewall being closer to the outer surface than the inner surface; and a reflector, disposed on the base, having a protruding portion extending upward in a direction opposite to the base, and a tilted sidewall on which the first upstanding light bar is positioned.

2. The LED light bulb of claim 1, wherein the first upstanding light bar is mounted on the protruding portion and arranged to emit light inward to the protruding portion.

3. The LED light bulb of claim 1, wherein the first upstanding light bar is spaced apart from the light transmissive cover.

4. The LED light bulb of claim 1, wherein the first upstanding light bar is bent inwardly.

5. The LED light bulb of claim 1, wherein the first upstanding light bar is bent outwardly.

6. The LED light bulb of claim 1, further comprising a heat sink connected to the outer surface of the first upstanding light bar.

7. The LED light bulb of claim 1, wherein the first upstanding light bar has a transparent of translucent printed circuit board.

8. The LED light bulb of claim 1, further comprising a plurality of second upstanding light bars, the second upstanding light bars and the first upstanding light bar are radially arranged on the tilted sidewall.

9. The LED light bulb of claim 8, further comprising a heat sink associated with the light transmissive cover to form an exterior of the LED light bulb.

10. The LED light bulb of claim 8, wherein the first upstanding light bar and the second upstanding light bars are arranged in a polygon pattern.

11. An LED light bulb, comprising:

a base;

a first upstanding light bar associated with the base and having an inner surface wherein an LED is arranged, and an outer surface opposite to the inner surface;

a light transmissive cover enclosing the inner surface and the outer surface, and having an inner sidewall being closer to the outer surface than the inner surface; and a reflector, disposed on the base, having a protruding portion extending upward in a direction opposite to the base, and a flat portion facing upward and on which the first upstanding light bar stands.

12. The LED light bulb of claim 11, wherein the reflector is a reflective polyhedron having joining faces and joining edges, the inner surface substantially faces at least one of the joining edges.

13. The LED light bulb of claim 11, wherein the reflector is a reflective polyhedron having joining faces and joining edges, the inner surface substantially faces at least one of the joining faces.

14. The LED light bulb of claim 11, wherein the protruding portion has a concave sidewall.

15. An LED light bulb, comprising:

a base;

a first upstanding light bar associated with the base and having an inner surface wherein an LED is arranged, and an outer surface opposite to the inner surface;

a light transmissive cover enclosing the inner surface and the outer surface, and having an inner sidewall being closer to the outer surface than the inner surface; and a reflector, disposed on the base, having a protruding portion extending upward in a direction opposite to the base and being a reflective polyhedron.

16. The LED light bulb of claim 15, wherein the reflective polyhedron has joining faces and joining edges, the inner surface substantially faces at least one of the joining faces.

17. The LED light bulb of claim 15, wherein the reflective polyhedron has joining faces and joining edges, the inner surface substantially faces at least one of the joining faces.

18. The LED light bulb of claim 15, wherein the reflective polyhedron has a shape of a curved polyhedron or a uniform pyramid.

19. The LED light bulb of claim 18, wherein the uniform pyramid has joining faces and joining edges, the reflector has reflective fins connecting to the joining edges.

20. The LED light bulb of claim 19, wherein the reflective fins and the light transmissive cover form an exterior of the LED light bulb.

* * * * *